US011211745B2

(12) United States Patent
Torrey et al.

(10) Patent No.: US 11,211,745 B2
(45) Date of Patent: Dec. 28, 2021

(54) ELECTRICAL CONNECTOR HEADER WITH STABILIZING FEATURES

(71) Applicant: TE Connectivity Services GmbH, Schaffhausen (CH)

(72) Inventors: Eric J. Torrey, Bloomfield Hills, MI (US); Hurley Chester Moll, Hershey, PA (US); Matthew Bryan Hitchcock, Hershey, PA (US)

(73) Assignee: TE Connectivity Services GmbH

( * ) Notice: Subject to any disclaimer, the term of this patent is extended or adjusted under 35 U.S.C. 154(b) by 0 days.

(21) Appl. No.: 16/872,732

(22) Filed: May 12, 2020

(65) Prior Publication Data

US 2021/0359464 A1 Nov. 18, 2021

(51) Int. Cl.
*H01R 13/627* (2006.01)
*H01R 13/05* (2006.01)

(52) U.S. Cl.
CPC ..... *H01R 13/6273* (2013.01); *H01R 13/055* (2013.01)

(58) Field of Classification Search
CPC .. H01R 13/6273; H01R 13/055; H01R 43/24; H01R 13/502; H01R 13/504; H01R 13/518; H01R 13/659
USPC ..... 439/352, 686, 687, 724, 541.5
See application file for complete search history.

(56) References Cited

U.S. PATENT DOCUMENTS 5,591,036 A * 1/1997 Doi ..... H01R 43/205 439/79
5,971,774 A * 10/1999 Kuki ..... H01R 12/712 439/79
5,975,917 A * 11/1999 Wang ..... H01R 43/20 29/884
6,033,258 A * 3/2000 Huang ..... H01R 13/514 439/541.5
6,095,853 A * 8/2000 Huang ..... H01R 12/727 439/541.5
6,183,270 B1 * 2/2001 Huang ..... H01R 12/727 439/541.5
6,773,272 B2 8/2004 Koehler et al.
7,080,990 B1 7/2006 Juntwait et al.
7,195,519 B1 * 3/2007 McAlonis ..... H01R 13/518 439/607.39
9,843,116 B2 * 12/2017 Endo ..... H01R 12/585
10,020,603 B1 7/2018 Yunxiang et al.
10,020,609 B2 7/2018 Matsumoto
10,455,712 B1 10/2019 Malecke et al.
(Continued)

FOREIGN PATENT DOCUMENTS

WO 2004/008584 A1 1/2004

OTHER PUBLICATIONS

International Search Report, International Application No. PCTIB2021/054050 International Filing Date, May 12, 2021.

*Primary Examiner* — Travis S Chambers

(57) ABSTRACT

An electrical connector having a housing having a pin plate holder and a pin block holder. The pin block holder has a pin block holder stabilizing section. The pin plate holder has a pin plate holder stabilizing portion. With the pin block holder and the pin plate holder fully mated, the pin block holder stabilizing section engages the pin plate holder stabilizing portion to prevent the movement of the pin plate holder relative to the pin block holder in multiple directions.

19 Claims, 9 Drawing Sheets

(56) References Cited

U.S. PATENT DOCUMENTS

2010/0267288 A1* 10/2010 Droesbeke ..... H01R 13/514
439/731

* cited by examiner

ELECTRICAL CONNECTOR HEADER WITH STABILIZING FEATURES

FIELD OF THE INVENTION

The present invention is directed to an electrical connector with stabilizing features which prevent movement of the components of the electrical connector relative to each other.

BACKGROUND OF THE INVENTION

When assembling an electrical connector to a mating electrical connector or panel, the positioning of the male blades of the terminals of the electrical connector must be controlled to ensure proper mating of the terminals of the electrical connector to mating terminals of the mating electrical connector or panel. Properly controlling the positioning of the male blades of the terminals minimizes the possibility of stubbing the terminals and the mating terminals as mating occurs. This is particularly important in connectors with numerous terminals.

As components of the electrical connector are mated together, the positioning and latching portions of the components cooperate with mating positioning and latching portions of other components, thereby allowing proper assembly of the components. Known positioning and latching portions are manufactured to facilitate some movement or play between the components, thereby facilitating easy assembly. While in many circumstances, the movement between the components is not harmful, in other circumstances, such as is situations where there are very tight tolerances, the movement of the components is not acceptable.

In order to more precisely control the location of the terminals and the components, the assembled electrical connector may be over-molded into an over-molded module. In so doing, the location of the terminals and components can be controlled. In addition, in environments in which vibration occurs, the over-molded module does not allow unwanted movement of the terminals or components during use.

It would be, therefore, be beneficial to provide an electrical connector with components which, when assembled, are prevented from moving relative to each other without the need for over-molding. In particular, it would be beneficial to provide an electrical connector with stabilizing features which prevent movement of the components of the electrical connector relative to each other.

SUMMARY OF THE INVENTION

An embodiment is directed to an electrical connector having a housing having a pin plate holder and a pin block holder. The pin block holder has a pin block holder stabilizing section, with the pin block holder stabilizing section having a stabilizing recess which extends from a first wall of the pin block holder. Ribs extend into the stabilizing recess from the walls of the stabilizing recess. The pin plate holder has a pin plate holder stabilizing portion, with the pin plate holder stabilizing portion having a stabilizing projection. The stabilizing projection has a first wall, an oppositely facing second wall and third walls which extend between the first wall and the second wall. Terminals are positioned in terminal receiving openings of the pin block holder and have mating portions positioned in the terminal receiving openings. With the pin block holder and the pin plate holder fully mated, the ribs of the pin block holder stabilizing section engage the stabilizing projection of the pin plate holder stabilizing portion to prevent the movement of the stabilizing projection and the pin plate holder relative to the stabilizing recess and the pin block holder in directions which are perpendicular to the longitudinal axis of the ribs.

An embodiment is directed to an electrical connector with a housing having a pin plate holder and a pin block holder. The pin block holder has a pin block holder stabilizing section, with the pin block holder stabilizing section having a stabilizing recess which extends from a first wall of the pin block holder. Ribs extend into the stabilizing recess from the walls of the stabilizing recess. Latching arms extend from a second wall of the pin block holder toward the first wall. The latching arms extend in a direction which is essentially parallel to a plane of the mating portions of the terminals. The pin plate holder has a pin plate holder stabilizing portion, with the pin plate holder stabilizing portion having a stabilizing projection. The stabilizing projection has a first wall, an oppositely facing second wall and third walls which extend between the first wall and the second wall. Latching projections extend from the pin plate holder. Each of the latching projections extend in a direction toward the stabilizing projection. Terminals are positioned in terminal receiving openings of the pin block holder, with the terminals having mating portions positioned in terminal receiving openings of the pin plate holder. With the pin block holder and the pin plate holder fully mated, the ribs of the pin block holder stabilizing section engage the stabilizing projection of the pin plate holder stabilizing portion to prevent the movement of the stabilizing projection and the pin plate holder relative to the stabilizing recess and the pin block holder in directions which are perpendicular to the longitudinal axis of the ribs. In addition, the latching arms of the pin block holder are prevented from movement relative to the pin plate holder in the direction of insertion by the engagement of the locking surfaces of the latching projections with free ends of the latching arms and by the engagement of an over insertion prevention wall with leading ends of the latching arms.

An embodiment is directed to an electrical connector having a housing having a pin plate holder and a pin block holder. The pin block holder has a pin block holder stabilizing section, with the pin block holder stabilizing section having a stabilizing recess which extends from a first wall of the pin block holder. Ribs extend into the stabilizing recess from the walls of the stabilizing recess. Latching arms extend from a second wall of the pin block holder toward the first wall. The latching arms extend in a direction which is essentially parallel to a plane of the mating portions of the terminals. The pin plate holder has a pin plate holder stabilizing portion with a rib receiving section which extends from a first wall of the pin plate holder in a direction toward a second wall of the pin plate holder. The rib receiving section has a rib receiving slot which opens toward the first wall of the pin plate holder. The pin plate holder stabilizing portion has a stabilizing projection, with the stabilizing projection having a first wall, an oppositely facing second wall and third walls which extend between the first wall and the second wall. Latching projections extend from the pin plate holder. Each of the latching projections extend in a direction toward the stabilizing projection. With the pin block holder and the pin plate holder fully mated, the unwanted movement of the pin block holder relative to the pin plate holder is prevented in directions which are perpendicular to the longitudinal axis of the ribs and in direction of insertion. The rib receiving slot of the pin plate holder cooperates with a positioning rib of a mating module housing to minimize movement of the electrical connector relative to the mating module housing.

Other features and advantages of the present invention will be apparent from the following more detailed description of the preferred embodiment, taken in conjunction with the accompanying drawings which illustrate, by way of example, the principles of the invention.

DETAILED DESCRIPTION OF THE INVENTION

Figure 1:
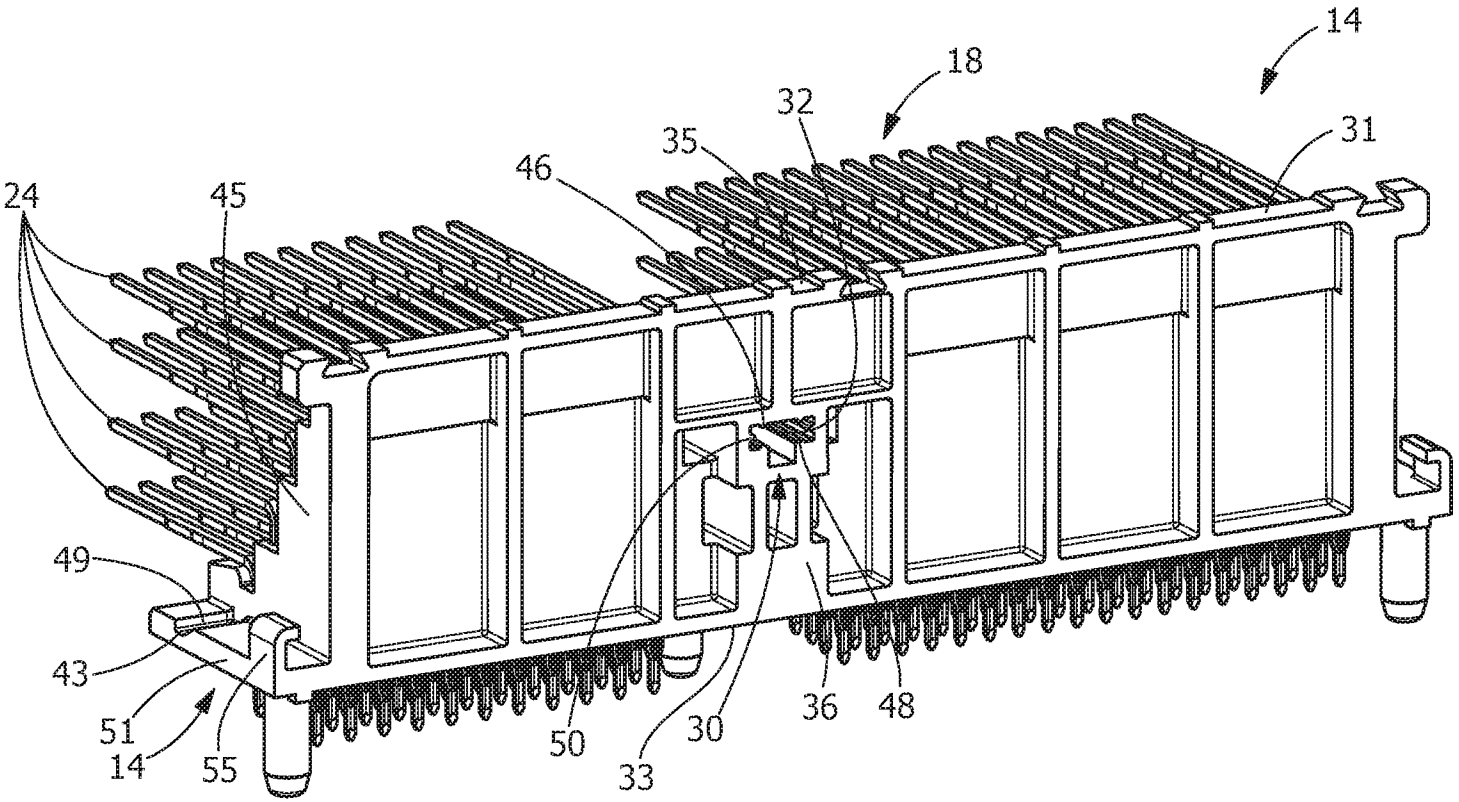
FIG. 1 is a front perspective view of an illustrative pin block holder of an illustrative electrical connector of the present invention.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise.

Moreover, the features and benefits of the invention are illustrated by reference to the preferred embodiments. Accordingly, the invention expressly should not be limited to such embodiments illustrating some possible non-limiting combination of features that may exist alone or in other combinations of features, the scope of the invention being defined by the claims appended hereto.

Figure 5:
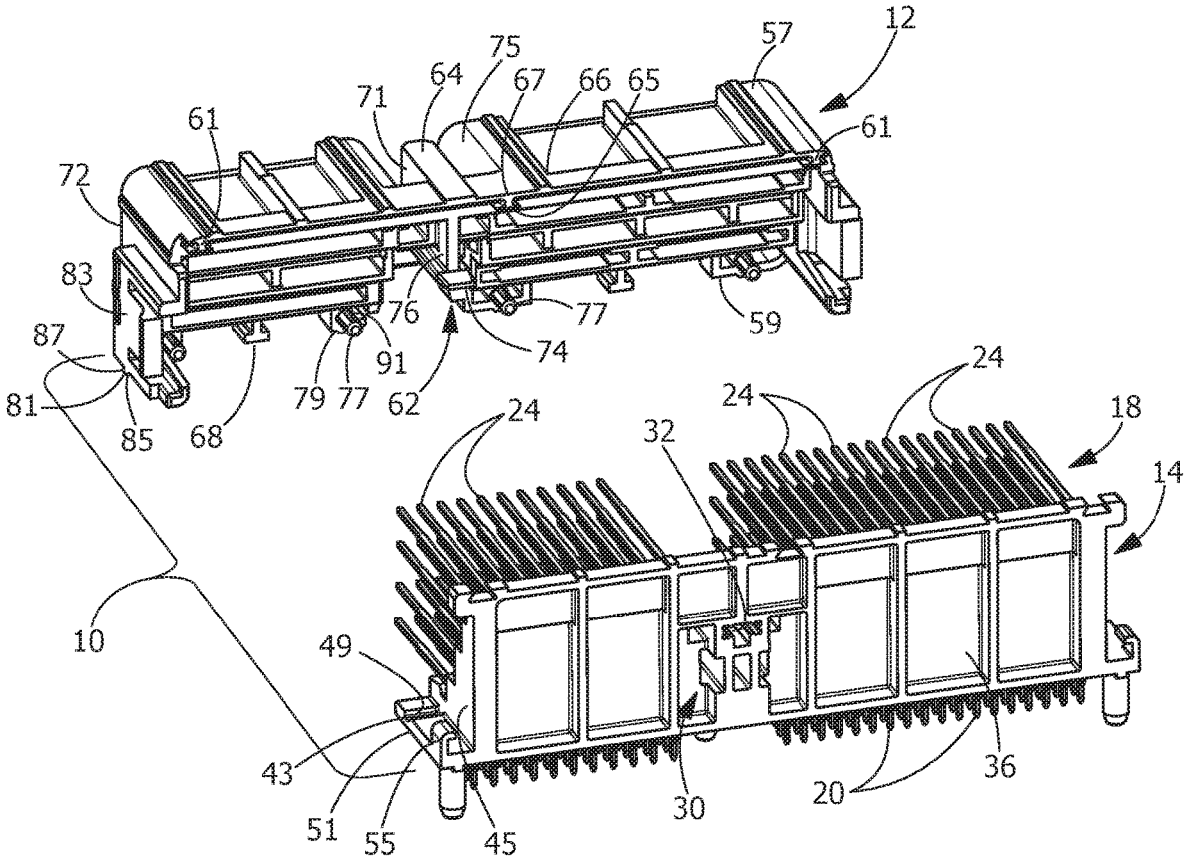
FIG. 5 is an exploded front perspective view of the electrical connector, showing the pin plate holder removed from the pin block holder.
Figure 6:
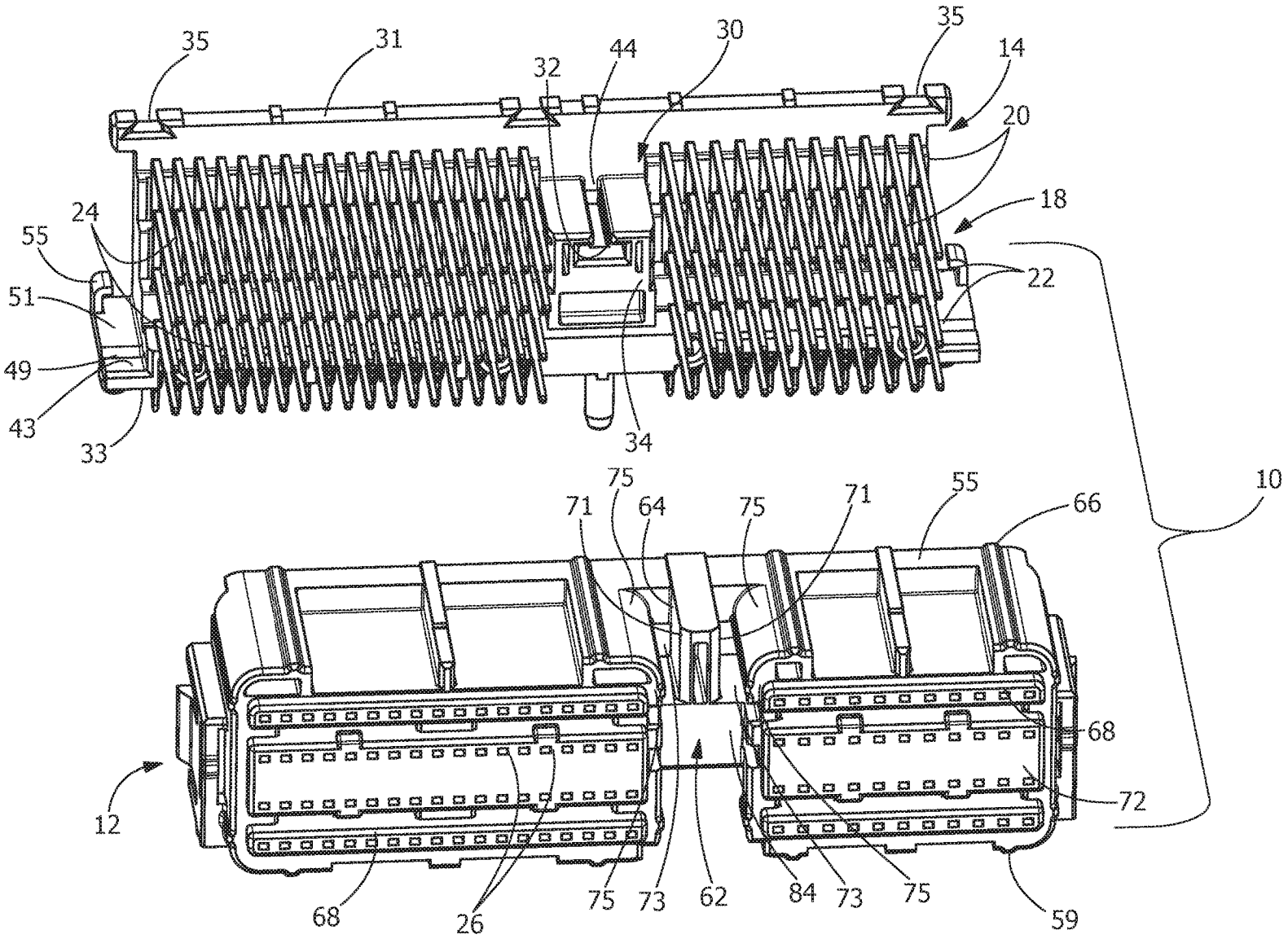
FIG. 6 is an exploded back perspective view of the electrical connector, showing the pin plate holder removed from the pin block holder.
Figure 7:
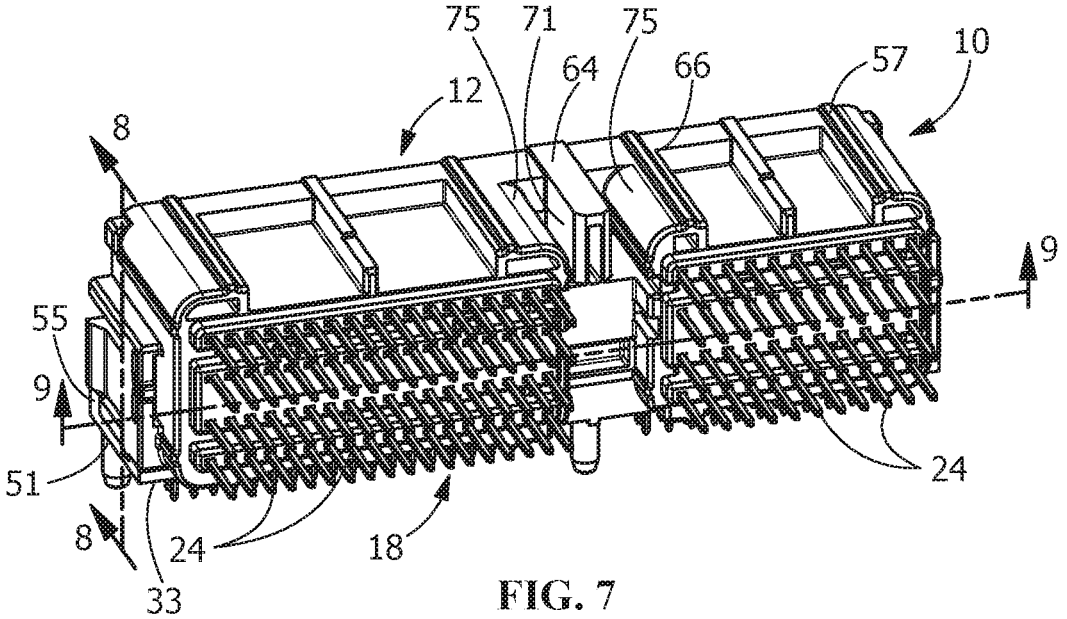
FIG. 7 is a front perspective view of the assembled electrical connector

As shown in FIGS. 5 through 7, an electrical connector assembly 10 has a pin plate holder 12 and a pin block holder 14 which are mated together, as shown in FIG. 7. In the illustrative embodiment shown, male blade terminals 18 are positioned in the pin block holder 14 and extend through the pin plate holder 12. The particular configuration and the number of the terminals 18 may vary without departing from the scope of the invention.

Figure 2:
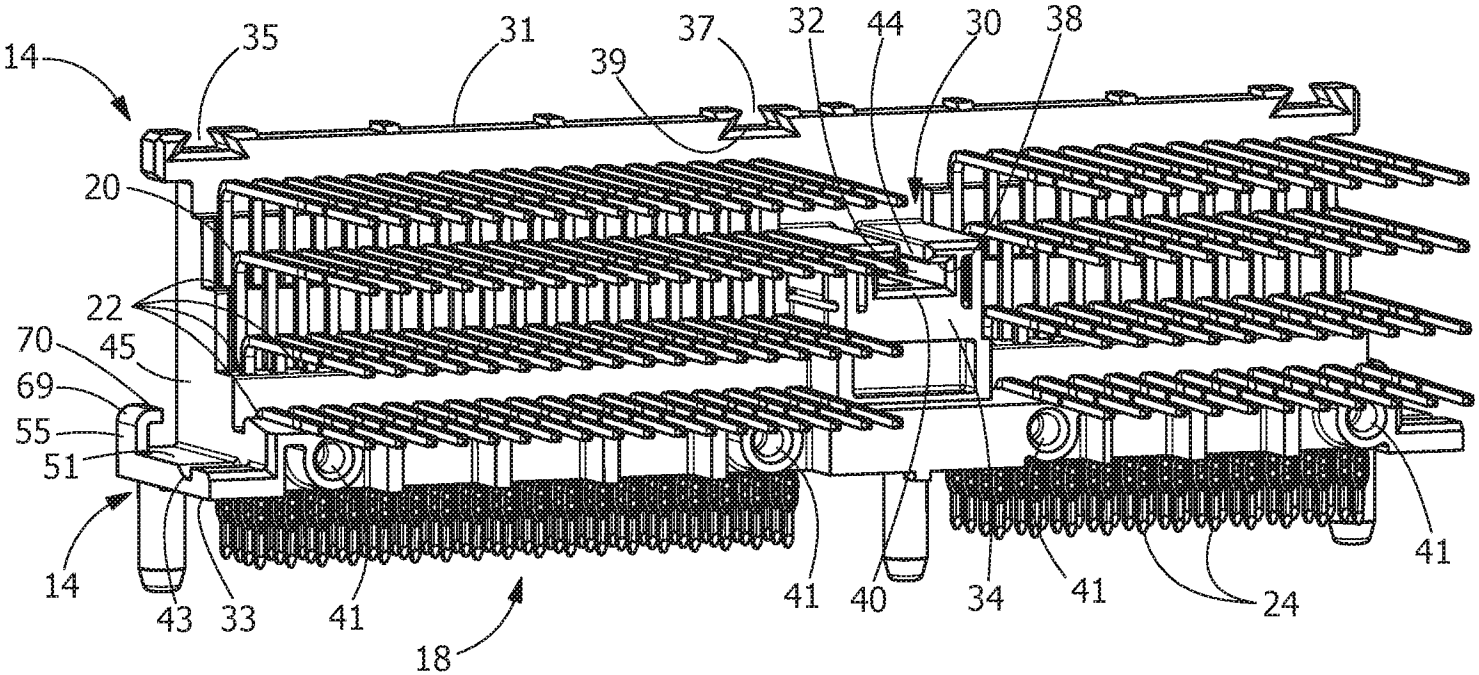
FIG. 2 is a rear perspective view of the pin block holder of FIG. 1.

During assembly, securing portions 20 (FIG. 2) of the terminals 18 are inserted into terminal receiving openings 22 of the pin block holder 14. The securing portions 20 may have compliant sections (not shown) or other mounting devices to properly secure the terminals 18 in the terminal receiving openings 22 of the pin block holder 14. As shown in FIG. 2, the terminal receiving openings 22 of the pin block holder 14 may be provided in rows which are spaced at different heights of the pin block holder 14, although other configurations of the terminal receiving openings 22 may be used. The cooperation of the securing portions 20 of the terminals 18 with the terminal receiving openings 22 of the pin block holder 14 securely positions and maintains the terminals 18 relative to the pin block holder 14.

With the terminals 18 properly positioned in the terminal receiving openings 22 of the pin block holder 14, the terminals 18 are bent to the position shown in FIG. 2. In this position, mating portions 24 of the terminals 18 are inserted into terminal receiving openings 26 (FIGS. 4 and 6) of the pin plate holder 12 when the plate holder 12 is moved into position on the pin block holder 14. In the fully assembled position, the mating portions 24 of the terminals 18 cooperate with the terminal receiving openings 26 of the pin plate holder 12 to securely position and maintain the terminals 18 relative to the plate holder 12.

As shown in FIGS. 1 and 2, the illustrative pin block holder 14 has a stabilizing section 30 positioned proximate the longitudinal center of the pin block holder 14. However, the stabilizing section 30 may be located at other positions on the pin block holder 14, and more than one stabilizing section 30 may be provided.

The stabilizing section 30 has a stabilizing recess 32 which extends from a front wall 34 (FIG. 2) of the pin block holder 14 toward a back wall 36 (FIG. 1). The stabilizing recess 32 extends in a direction which is essentially parallel to the plane of the mating portions 24 of the terminals 18. As viewed in FIG. 8, the stabilizing recess 32 has a first or top wall 38, an opposed second or bottom wall 40 and side walls 42. A slot 44 extends from the top wall 38 in a direction away from the bottom wall 40. Ribs or projections 46 extend from the top wall 38 in a direction toward the bottom wall 40. Ribs or projections 48 extend from the bottom wall 40 in a direction toward the top wall 38. Ribs or projections 50 extend from each of the side walls 42 in a direction toward the opposite sidewall 42.

Figure 9:
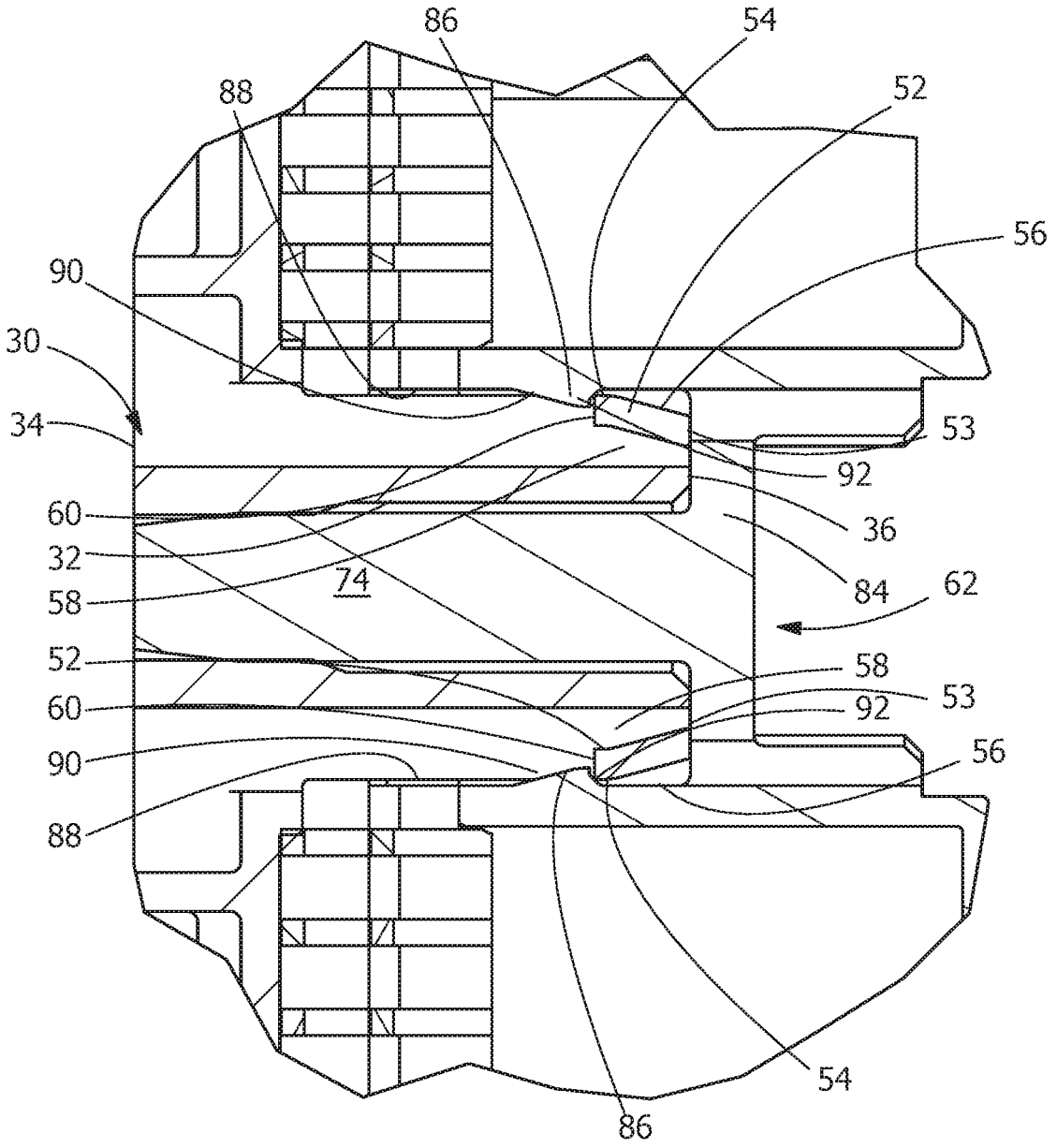
FIG. 9 is an enlarged cross-sectional view taken along line 9-9 of FIG. 7.

As shown in FIG. 9, the stabilizing section 30 has latching arms 52 which extend from the back wall 36 of the pin block holder 14 toward the front wall 34. The latching arms 52 extend in a direction which is essentially parallel to the plane of the mating portions 24 of the terminals 18 (FIGS. 1 and 2). The latching arms 52 have side walls 54. Lead-in surfaces 56 are provided on the side walls 54 of the latching arms 52. Spaces or slots 58 are provided proximate free ends 60 of the latching arms 52, thereby allowing the latching arms to be resiliently moved relative to the remainder of the stabilizing section 30.

As shown in FIGS. 1, 2, 5 and 6, the pin block holder 14 has a top wall 31 and an oppositely facing bottom wall 33. Openings or cavities 35 extend from the top wall 31. In the illustrative embodiment shown, the cavities 35 have a dovetail configuration with open ends 37 (FIG. 2) which are smaller than closed ends 39 of the cavities 35. The cavities 35 are positioned spaced apart along the length of the top wall 31.

As shown in FIG. 2, securing openings 41 are positioned proximate the bottom wall 33 of the pin block holder 14. In the illustrative embodiment shown, the securing openings 41 have a cylindrical configuration. The securing openings 41 are positioned spaced apart along the length of the bottom wall 33 and extend from the back wall 36 toward the front wall 34.

Locking projection receiving recesses 43 are provided on shoulders 51 which extend from side walls 45 of the pin block holder 14 proximate the bottom wall 33 of the pin block holder 14. The locking projections receiving recesses 43 have locking surfaces 49. The locking surfaces 49 extend in a direction which is essentially perpendicular to the plane of the bottom wall 33. Securing projections 55 extend from the shoulders 51 in a direction toward the top wall 31. The securing projections 55 have an arcuate bend 69 with a securing shoulder 70 projecting therefrom.

As shown in FIGS. 3 through 6, the illustrative pin plate holder 12 has a stabilizing section 62 positioned proximate the longitudinal center of the pin plate holder 12. However, the stabilizing section 62 may be located at other positions on the pin plate holder 12 which are aligned with the stabilizing section 30 of the pin block holder 12. In addition, more than one stabilizing section 62 may be provided.

The stabilizing section 62 has a rib receiving section 64 which extends from a first or top wall 66 in a direction toward a bottom or second wall 68. The rib receiving section 64 has oppositely facing side walls 71 which are positioned proximate rib receiving slots 73. The rib receiving slots 73 have enlarged areas 75 which extend therefrom. The rib receiving section 64 is described in co-pending U.S. patent application Ser. No. 16/872,658, entitled Modular Housing Assembly With Stabilizing Features, filed on the same date of this application, which is incorporated by reference herein in its entirety.

Figure 8:
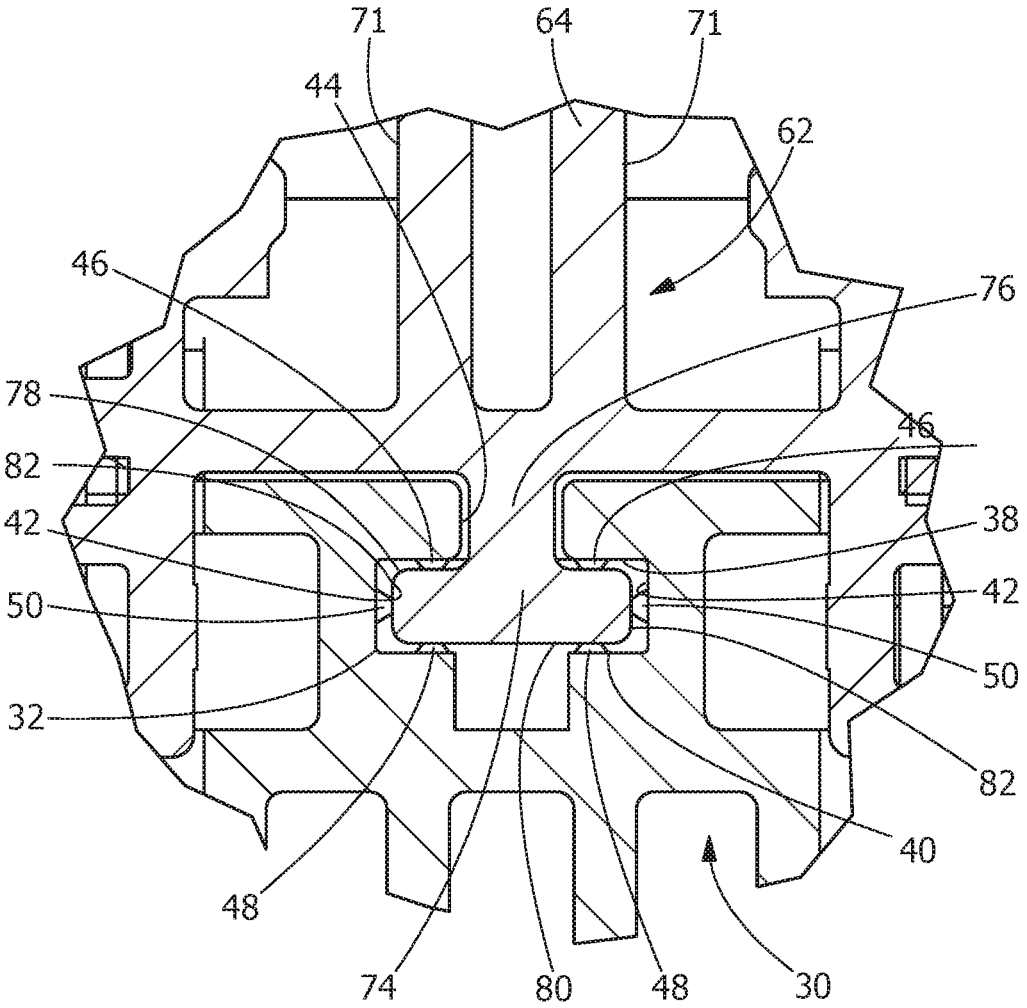
FIG. 8 is an enlarged cross-sectional view taken along line 8-8 of FIG. 7.

A stabilizing projection 74 is positioned below the rib receiving section 64. As shown in FIG. 8, a connecting portion 76 connects the stabilizing projection 74 with the rib receiving section 64. The stabilizing projection 74 has a first or top surface 78, an opposed second or bottom surface 80 and side surface 82. The connecting portion 76 extends from the first or top surface 78 of the stabilizing projection 74 in a direction away from the second or bottom surface 80 of the stabilizing projection 74. The stabilizing projection 74 extends in a direction which is essentially parallel to the plane of the mating portions 24 of the terminals 18. An over insertion prevention wall 84 (FIGS. 6 and 9) is provided proximate the connecting portion 76 and the stabilizing projection 74. The over insertion prevention wall 84 extends in a plane which is essentially perpendicular to the planes of the connecting portion 76 and the stabilizing projection 74.

As shown in FIG. 9, the stabilizing section 62 has latching projections 86 which extend from walls 88 of the pin plate holder 12. Each of the latching projections 86 extend in a direction toward the stabilizing projection 74. The latching projections 86 have lead-in surfaces 90 and locking surfaces 92.

Figure 3:
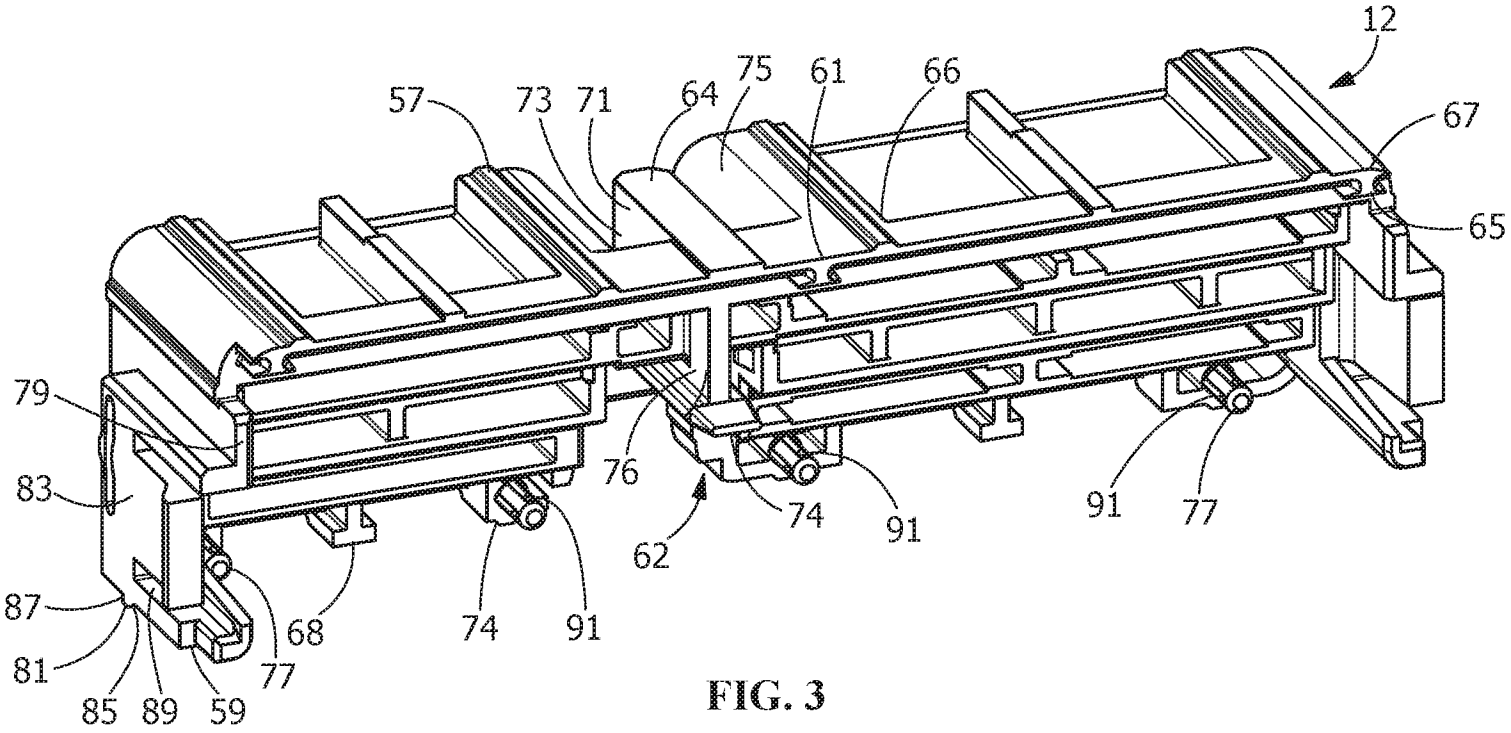
FIG. 3 is a front perspective view of an illustrative pin plate holder of the electrical connector of the present invention.

As shown in FIGS. 3 and 5, the pin plate holder 12 has a top wall 57 and an oppositely facing bottom wall 59. Projections 61 extend from proximate the top wall 57. In the illustrative embodiment shown, the projections 61 have a dovetail configuration with first ends 65 which are larger than second ends 67 of the projections 61. The projections 61 are positioned periodically along the length of the top wall 57. The spacing and positioning of the projections 61 corresponds to the spacing and positioning of the cavities 35 of the pin block holder 14.

Securing projections 77 are positioned proximate the bottom wall 59 of the pin plate holder 12. In the illustrative embodiment shown, the securing projections 77 have a cylindrical configuration. The securing projections 77 are positioned spaced apart along the length of the bottom wall 59 and extend from a back face 79 of the pin plate holder 12 in a direction away from the front face 72 of the pin plate holder 12. The spacing and positioning of the projections 77 corresponds to the spacing and positioning of the securing openings 41 of the pin block holder 14.

As shown in FIG. 3, crush ribs 91 extend from the securing projections 77 about the circumference of the securing projections 77. In the illustrative embodiment shown, four crush ribs 91 are provided about each securing projection 77, with the ribs 91, being equally spaced from each other. The diameter of the securing projections 77, as measured at the crush ribs 91 is larger than the diameter of the securing openings 41 (FIG. 2) of the pin block holder 14.

Figure 4:
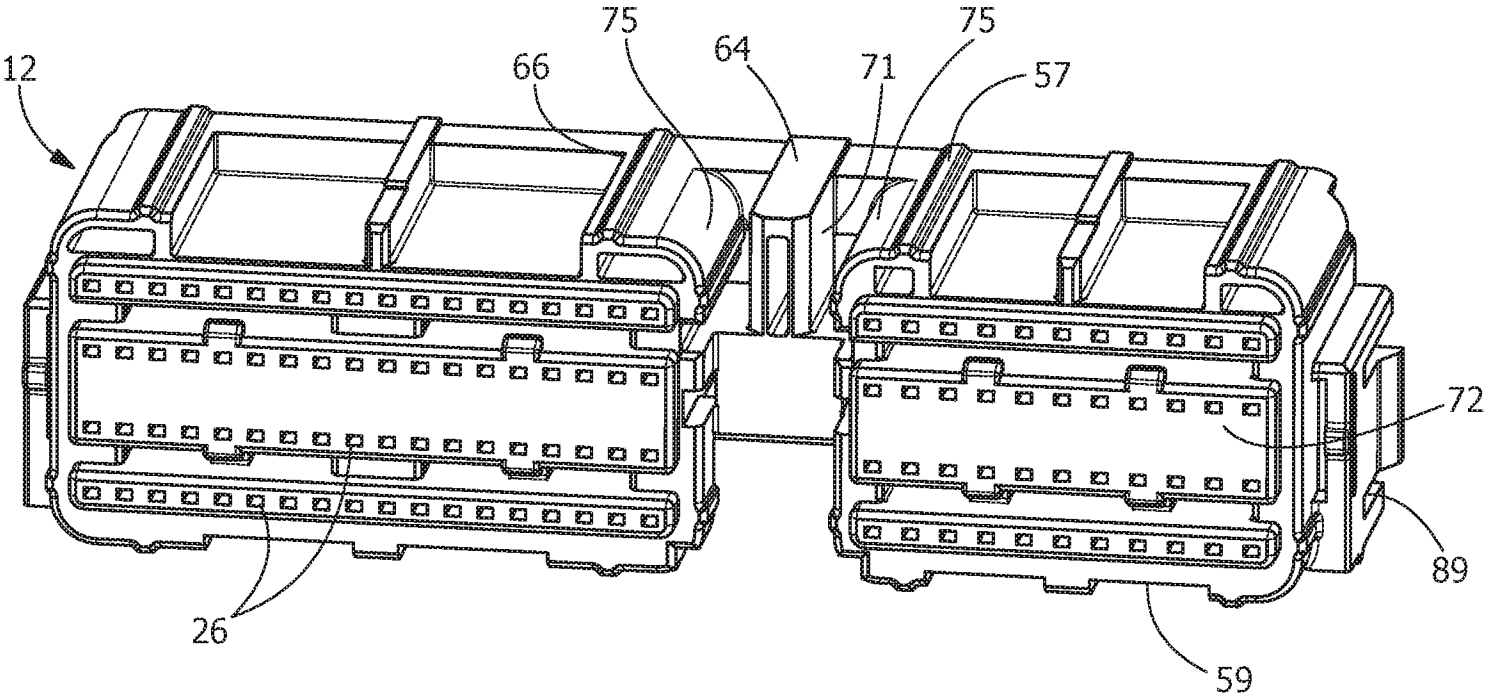
FIG. 4 is a rear perspective view of the pin plate holder of FIG. 3.

Locking projections 81 extend from the bottom wall 59 of the pin plate holder 12. The locking projections 81 are provided proximate side walls 83 of the pin plate holder 12. The locking projections 81 have sloped or lead-in surfaces 85 and locking shoulders 87 which extend from the lead-in surfaces 85 to the bottom wall 59. The locking shoulders 87 extend in a direction which is essentially perpendicular to the plane of the bottom wall 59. Slots 89 are provided on the side walls 83 and extend from the back face 79 in a direction toward from the front face 72 (FIG. 4).

As the pin plate holder 12 is assembled onto the pin block holder 14, the pin plate holder 12 is moved toward the pin block holder 14 in a direction which is essentially parallel to the plane of the mating portions 24 of the terminals 18. As this occurs, the mating portions 24 of the terminals 18 are initially inserted into the terminal receiving openings 26 of the pin plate holder 12. As the assembly continues, the connecting portion 76 of the pin plate holder 12 is moved into slot 44 of the pin block holder 14 and the stabilizing projection 74 of the pin plate holder 12 is moved into stabilizing recess 32 of the pin block holder 14.

As the pin plate holder 12 and the pin block holder 14 are mated together, the projections 61 of the pin plate holder 12 are moved into the cavities 35 of the pin block holder 14. In addition, the securing projections 77 of the pin plate holder 12 are moved into the securing openings 41 of the pin block holder 14, causing the crush ribs 91 to deform as they are inserted into the securing openings 41.

As the mating or insertion continues, the mating portions 24 of the terminals 18 are inserted further into the terminal receiving openings 26 of the pin plate holder 12, the connecting portion 76 of the pin plate holder 12 is moved further into slot 44 of the pin block holder 14 and the stabilizing projection 74 of the pin plate holder 12 is moved further into stabilizing recess 32 of the pin block holder 14. As insertion continues, as shown in FIG. 9, the lead-in surfaces 90 of the latching projections 86 of the pin plate holder 12 engage the lead-in surfaces 56 of the latching arms 52 of the pin block holder 14, causing the latching arms 52 to be resiliently deformed toward the stabilizing recess 32. In addition, the locking projections 81 of the pin plate holder 12 enter the locking projection receiving recesses 43 of the pin block holder 14. The securing shoulders 70 of the securing projections 55 of the pin block holder 14 also enter the slots 89 of the pin plate holder 12.

In the fully inserted position, the latching projections 86 of the pin plate holder 12 are moved past the latching arms 52 of the pin block holder 14, allowing the latching arms 52 to be resiliently returned to their unstressed position, as shown in FIG. 9. In this position, the locking surfaces 92 of the latching projections 86 engage the free ends 60 of the latching arms 52 to prevent the unwanted unmating of the pin plate holder 12 from the pin block holder 14. In addition, the locking surfaces 49 of the locking projection receiving recesses 43 of the pin block holder 14 engage the locking shoulders 87 of the locking projections 81 of the pin plate holder 12 to prevent the unwanted unmating of the pin plate holder 12 from the pin block holder 14.

In the fully inserted position, as shown in FIG. 9, the locking surfaces 92 of the latching projections 86 engage the free ends 60 of the latching arms 52 and the over insertion prevention wall 84 engages the leading ends 53 of the latching arms 52 which are positioned proximate the back wall 36 of the pin block holder 14. In this position, the pin block holder 14 is prevented from movement relative to the pin plate holder 12 in two directions which are parallel to the plane of insertion. In other words, the pin block holder 14 is precisely positioned in the pin plate holder 12 and prevented from unwanted movement in the direction toward the back face 79 or toward the front face 72.

In the fully inserted position, as shown in FIG. 8, the stabilizing projection 74 is positioned in the stabilizing recess 32. In this position, the ribs 46, ribs 48 and ribs 50 engage the stabilizing projection 74 to prevent the movement of the stabilizing projection 74 and the pin plate holder 12 relative to the stabilizing recess 32 and the pin block holder 14 in four directions which are perpendicular to the plane of insertion. In other words, the pin block holder 14 is precisely positioned in the pin plate holder 12 and prevented from unwanted movement in the direction toward either side wall 83, toward the top wall 57 or away from the top wall 57. This allows the pin block holder 14 to be properly positioned relative to the pin plate holder 12, thereby eliminating the need for over-molding of parts or components.

In the fully inserted position, the projections 61 of the pin plate holder 12 are moved into the cavities 35 of the pin block holder 14. In the position, the shape of the projections 61 and cavities 35 also prevents the movement of the projections 61 and the pin holder 12 relative to the cavities 35 and the pin block holder 14 in four directions which are perpendicular to the plane of insertion, which were previously described.

In the fully inserted position, the securing projections 77 of the pin plate holder 12 are positioned in the securing openings 41 of the pin block holder 14. As the crush ribs 91 deform as they are inserted into the securing openings 41, an interference fit is provided between the securing projections 77 and the securing openings 41. In the position, the cooperation of the securing projections 77 and the securing openings 41 also prevent the movement of the securing projections 77 and the pin holder 12 relative to the securing openings 41 and the pin block holder 14 in four directions which are perpendicular to the plane of insertion, which were previously described. In addition, the interference fit provided between the securing projections 77 and the securing openings 41 helps to secure the pin holder 12 relative to the pin block holder 14 in the plane of insertion, preventing the unwanted unmating of the pin plate holder 12 from the pin block holder 14.

The cooperation and interaction of the securing components of the pin block holder 14 with the securing components of the pin plate holder 12 provides a stable mating between the pin block holder 14 and the pin plate holder 12 in the six directions (two directions previously described and four directions previously described), thereby minimizing movement of the pin plate holder 12, the pin block holder 14 and the terminals 18 relative to each other when assembled. As the securing components are positioned at different locations of the electrical connector assembly, i.e. at the ends, at the top and bottom and in the center, this allows all parts of the electrical connector assembly 10 to be accurately and precisely located and fixed to allow the electrical connector assembly 10 to be properly positioned relative to a module or mating connector, thereby eliminating the need for over-molding of parts or components.

One skilled in the art will appreciate that the invention may be used with many modifications of structure, arrangement, proportions, sizes, materials and components and otherwise used in the practice of the invention, which are particularly adapted to specific environments and operative requirements without departing from the principles of the present invention. The presently disclosed embodiments are therefore to be considered in all respects as illustrative and not restrictive, the scope of the invention being defined by the appended claims, and not limited to the foregoing description or embodiments.

The invention claimed is:

1. An electrical connector comprising:

a housing having a pin plate holder and a pin block holder;

the pin block holder having a pin block holder stabilizing section, the pin block holder stabilizing section having a stabilizing recess which extends from a first wall of the pin block holder, ribs extend into the stabilizing recess from walls of the stabilizing recess, latching arms extend from a second wall of the pin block holder toward the first wall, the latching arms extend in a direction which is essentially parallel to a plane of mating portions of terminals positioned in terminal receiving openings of the pin block holder;

the pin plate holder having a pin plate holder stabilizing portion, the pin plate holder stabilizing portion having a stabilizing projection, the stabilizing projection having a first wall, an oppositely facing second wall and third walls which extend between the first wall and the second wall;

the terminals having mating portions positioned in terminal receiving openings of the pin plate holder;

wherein with the pin block holder and the pin plate holder fully mated, the pin block holder is positioned in the pin plate holder and prevented from unwanted movement perpendicular to the plane of insertion and parallel to the plane of insertion.

2. The electrical connector as recited in claim 1, wherein the pin plate holder stabilizing section has latching projections which extend from walls of the pin plate holder, each of the latching projections extend in a direction toward the stabilizing projection.

3. The electrical connector as recited in claim 1, wherein the latching projections have lead-in surfaces and locking surfaces, wherein with the pin block holder and pin plate holder fully mated, the latching arms of the pin block holder are prevented from movement relative to the pin plate holder in the direction of insertion by the engagement of the locking surfaces of the latching projections with free ends of the latching arms and by the engagement of an over insertion prevention wall with leading ends of the latching arms.

4. The electrical connector as recited in claim 1, wherein the latching arms have side walls which face in a direction away from the stabilizing recess, lead-in surfaces are provided on the side walls of the latching arms, spaces are provided proximate free ends of the latching arms, wherein the latching arms are resiliently moved relative to the remainder of the stabilizing section as the pin block holder and pin plate holder are mated together.

5. The electrical connector as recited in claim 4, wherein the stabilizing recess extends the first wall of the pin block holder in a direction which is essentially parallel a plane of the mating portions of the terminals.

6. The electrical connector as recited in claim 1, wherein the pin block holder stabilizing section is positioned proximate the longitudinal center of the pin block holder.

7. The electrical connector as recited in claim 1, wherein the pin block holder has a top wall and an oppositely facing bottom wall, cavities are positioned periodically along the length of the top wall, the cavities have a dovetail configuration.

8. The electrical connector as recited in claim 7, wherein securing openings are positioned periodically along the length of the bottom wall of the pin block holder, the securing openings have a cylindrical configuration.

9. The electrical connector as recited in claim 1, wherein the pin plate holder stabilizing portion has a rib receiving section which extends from the first wall of the pin plate holder in a direction toward the second wall of the pin plate holder, the rib receiving section has a rib receiving slot which opens toward the first wall of the pin plate holder.

10. The electrical connector as recited in claim 9, wherein the stabilizing projection is positioned below the rib receiving section, a connecting portion connects the stabilizing projection with the rib receiving section.

11. The electrical connector as recited in claim 10, wherein an over insertion prevention wall is provided proximate the connecting portion and the stabilizing projection, the over insertion prevention wall extends in a plane which is essentially perpendicular to the planes of the connecting portion and the stabilizing projection.

12. The electrical connector as recited in claim 7, wherein locking projection receiving recesses are provided on shoulders which extend from side walls of the pin block holder proximate the bottom wall of the pin block holder, the locking projections receiving recesses have locking surfaces.

13. The electrical connector as recited in claim 12, wherein the pin plate holder has a top wall and an oppositely facing bottom wall, projections are positioned periodically along the length of the top wall, the spacing and positioning of the projections corresponds to the spacing and positioning of the cavities of the pin block holder, the projections have a dovetail configuration.

14. The electrical connector as recited in claim 13, wherein securing projections are positioned periodically along the length of the bottom wall of the pin plate holder, the spacing and positioning of the securing projections corresponds to the spacing and positioning of the securing openings of the pin block holder, the securing projections have a cylindrical configuration.

15. The electrical connector as recited in claim 14, wherein crush ribs extend from the securing projections, a diameter of the securing projections, as measured at the crush ribs is larger than a diameter of the securing openings of the pin block holder.

16. The electrical connector as recited in claim 14, wherein locking projections extend from the bottom wall of the pin plate holder proximate side walls of the pin plate holder, the locking projections have locking shoulders.

17. An electrical connector comprising:

a housing having a pin plate holder and a pin block holder;

the pin block holder having a pin block holder stabilizing section, the pin block holder stabilizing section having a stabilizing recess which extends from a first wall of the pin block holder, ribs extend into the stabilizing recess from the walls of the stabilizing recess, latching arms extend from a second wall of the pin block holder toward the first wall, the latching arms extend in a direction which is essentially parallel to a plane of the mating portions of the terminals;

the pin plate holder having a pin plate holder stabilizing portion, the pin plate holder stabilizing portion having a stabilizing projection, the stabilizing projection having a first wall, an oppositely facing second wall and third walls which extend between the first wall and the second wall, latching projections extend from the pin plate holder, each of the latching projections extend in a direction toward the stabilizing projection;

terminals positioned in terminal receiving openings of the pin block holder, the terminals having mating portions positioned in terminal receiving openings of the pin plate holder;

wherein with the pin block holder and the pin plate holder fully mated, the ribs of the pin block holder stabilizing section engage the stabilizing projection of the pin plate holder stabilizing portion to prevent the movement of the stabilizing projection and the pin plate holder relative to the stabilizing recess and the pin block holder in directions which are perpendicular to the longitudinal axis of the ribs;

wherein with the pin block holder and the pin plate holder fully mated, the latching arms of the pin block holder are prevented from movement relative to the pin plate holder in the direction of insertion by the engagement of the locking surfaces of the latching projections with free ends of the latching arms and by the engagement of an over insertion prevention wall with leading ends of the latching arms.

18. The electrical connector as recited in claim 17, wherein the latching arms have side walls which face in a direction away from the stabilizing recess, lead-in surfaces are provided on the side walls of the latching arms, spaces are provided proximate free ends of the latching arms, wherein the latching arms are resiliently moved relative to the remainder of the stabilizing section as the pin block holder and pin plate holder are mated together.

19. An electrical connector comprising:

a housing having a pin plate holder and a pin block holder;

the pin block holder having a pin block holder stabilizing section, the pin block holder stabilizing section having a stabilizing recess which extends from a first wall of the pin block holder, ribs extend into the stabilizing recess from the walls of the stabilizing recess, latching arms extend from a second wall of the pin block holder toward the first wall, the latching arms extend in a direction which is essentially parallel to a plane of the mating portions of the terminals;

the pin plate holder having a pin plate holder stabilizing portion, the pin plate holder stabilizing portion having a rib receiving section which extends from a first wall of the pin plate holder in a direction toward a second wall of the pin plate holder, the rib receiving section has a rib receiving slot which opens toward the first wall of the pin plate holder, the pin plate holder stabilizing portion having a stabilizing projection, the stabilizing projection having a first wall, an oppositely facing second wall and third walls which extend between the first wall and the second wall, latching projections extend from the pin plate holder, each of the latching projections extend in a direction toward the stabilizing projection;

wherein with the pin block holder and the pin plate holder fully mated, the unwanted movement of the pin block holder relative to the pin plate holder is prevented in directions which are perpendicular to the longitudinal axis of the ribs and in direction of insertion;

wherein the rib receiving slot of the pin plate holder cooperates with a positioning rib of a mating module housing to minimize movement of the electrical connector relative to the mating module housing.

* * * * *